US005695078A

United States Patent [19]

Otema

[11] Patent Number: 5,695,078

[45] Date of Patent: Dec. 9, 1997

[54] ADJUSTABLE STANDARD SYSTEM

[76] Inventor: Martin Otema, 15 Pine Ridge Dr., Scarborough, Ontario, Canada, M1M 2X4

[21] Appl. No.: 624,912

[22] Filed: Mar. 27, 1996

[51] Int. Cl.[6] ..... A47F 5/00

[52] U.S. Cl. ..... 211/103; 211/90; 211/187; 108/108; 248/244

[58] Field of Search ..... 211/208, 94.5, 211/193, 103, 90, 187, 94; 108/108, 110; 248/244, 245

[56] References Cited

U.S. PATENT DOCUMENTS

| | | | |
|---|---|---|---|
| 318,343 | 5/1885 | Baublits | 248/244 |
| 634,091 | 10/1899 | Newlee | 248/244 |
| 2,937,766 | 5/1960 | Penn | 211/193 |
| 3,114,531 | 12/1963 | Weber | 248/242 |
| 3,286,662 | 11/1966 | Connery | 248/244 X |
| 3,561,713 | 2/1971 | Berkowitz et al. | 248/242 |
| 4,819,900 | 4/1989 | Funk | 211/90 X |
| 5,253,835 | 10/1993 | Herron, III | 211/187 X |
| 5,452,875 | 9/1995 | Kern | 248/242 |

FOREIGN PATENT DOCUMENTS

| | | |
|---|---|---|
| 368186 | 5/1990 | European Pat. Off. . |
| 279992 | 11/1927 | United Kingdom . |
| 740311 | 11/1955 | United Kingdom . |
| 762621 | 4/1958 | United Kingdom . |
| 1269935 | 4/1972 | United Kingdom . |
| 2207340 | 2/1989 | United Kingdom . |

*Primary Examiner*—Robert W. Gibson, Jr.

[57] ABSTRACT

The invention provides an adjustable standard system for a shelving or display unit having support means comprising supporting hardware attached to a sliding body engaged about a mounting rail. The rail comprises an enlarged front edge or bead which extends through a channel in the sliding body such that the sliding body can slide freely but cannot become detached from the rail. In a preferred embodiment the rail has a tongue provided with openings into which a latch projecting from the support means can be selectively engaged. The rail can be provided with hooks configured to mount on a conventional slotted standard, or with any other securing means which allows the rail to be mounted on a supporting surface. The standard system of the invention provides greater aesthetic appeal than a conventional standard system. Moreover, the sliding body can be engaged to and adjusted on the mounting rail without tilting the supporting hardware, which requires less clearance above supporting structures such as shelves, platforms and the like which increases the number of positions available for such structures, and permits supporting structures and hardware to be rearranged without removing stored or displayed articles.

10 Claims, 20 Drawing Sheets

ADJUSTABLE STANDARD SYSTEM

FIELD OF INVENTION

This invention relates to standard systems. In particular, this invention relates to an adjustable standard system for display and shelving units, for positioning at a selected height hardware such as brackets, hooks, hangars and the like, for supporting or suspending articles or structures for supporting articles such as shelves, platforms, etc.

BACKGROUND OF THE INVENTION

For storing and displaying articles in shelving and display units, wall shelving units, warehouse shelving and the like used in such applications as merchandising, home furnishing and storage, it is advantageous to provide hardware and supporting structures which are adjustable in height. Depending upon the nature of the articles to be stored or displayed, such units may utilize many different types of hardware affixed to a supporting wall or pedestal, such as shelf brackets, hooks, hangars and other hardware of varying configurations.

The most common standard system used for support in these types of units utilizes a slotted standard, which is essentially a metal channel with a main face having a column of vertical slots. Various shapes and styles of brackets are designed with one, two or three barbed or hooked flanges spaced to fit into the slots in the standard. An example is illustrated in FIG. 1.

While the slotted standard provides a degree of versatility in the height at which the shelves and other supporting structures can be mounted, it is conspicuous and quite unattractive. Decorative display and shelving units are often designed primarily for aesthetic appeal, and the presence of visible hardware significantly detracts from the visual appeal of any display case. The slotted standard can be recessed into the supporting surface, but the slotted main face of the standard remains largely visible. The slotted standard has nevertheless been favoured by producers of display and shelving units, because prior to the invention there has been no satisfactory alternative which provides the same degree of versatility and adjustability in the height at which hardware can be mounted.

There are nevertheless limitations to the adjustability of hardware in a system using the slotted standard. To prevent accidental disengagement of the mounted bracket from the standard the uppermost hook on the bracket or other hardware is provided with a structure such as an opposed tooth, shown in FIG. 1, which requires that the bracket be tilted upwardly in order to be inserted or removed. Sufficient clearance is required above the bracket to allow room to tilt the bracket upwardly for insertion and removal. Less frequently, the hooks on the bracket are designed to engage the standard in an interference fit, which requires that the bracket be inserted into the standard and then forced down into a frictionally locked position. This requires sufficient clearance for maneuvering a tool to strike the bracket into the locked position.

The positions at which shelves or other supporting structures can be mounted on the standard 10 are thus limited by the need for this clearance above the bracket, especially dose to a fixed shelf or a horizontal panel such as the ceiling of a storage or display unit. Moreover, in order to rearrange the hardware in such a unit, for example to adjust the height of shelves or platforms, stored or displayed articles must first be removed. This results in wasted time and often considerable labour costs.

SUMMARY OF THE INVENTION

This invention overcomes these disadvantages by providing an adjustable standard system utilizing a mounting rail wherein the support means comprises hardware attached to a sliding body which can slide freely along the rail but cannot become detached from the rail. The rail can be mounted on any supporting surface in a display or storage unit in numerous different ways. The invention is easily adapted to be mounted on a slotted standard and can thus be retro fitted to existing display and shelving units. The mounting rail can be recessed into a supporting surface so that virtually only the front edge of the rail is visible. The clean, continuous lines of the rail provide a much more attractive alternative to the slotted face of the standard, and the rail can be more readily finished with chrome plating or another finish that matches the display unit.

In the preferred embodiment, the rail is provided with openings into which a latch projecting from the support means can be selectively engaged. The openings can be provided along the entire length of the rail, and are largely concealed behind the enlarged front edge of the rail. Since the height of the sliding body can thus be adjusted without tilting or forcing it into or out of engagement with the standard, there is greater flexibility in the placement of hardware and supporting structures in a shelving or display unit, and the height of shelves and platforms can be adjusted without first removing articles from the unit. As such, the standard system of the invention provides a more versatile and much more attractive alternative to systems utilizing the slotted standard.

The invention thus provides an adjustable standard system comprising a mounting rail for mounting on a supporting surface, support means comprising a sliding body slidably disposed on the mounting rail, and locking means for engaging the mounting rail and fixing the sliding body at a selected position on the rail.

The invention further provides, in combination, a mounting rail for mounting on a supporting surface, having an enlarged portion extending along substantially the length of the mounting rail, and support means slidably engaged about the mounting rail comprising a sliding body, means for supporting articles attached to the sliding body, and means for engaging the mounting rail at a plurality of positions along the length of the mounting rail, such that the sliding body can be positioned at one position of the plurality of positions along the mounting rail and engaged to the mounting rail at said one position to support the means for supporting articles.

BRIEF DESCRIPTION OF THE DRAWINGS

In drawings which illustrate a preferred embodiment of the invention by way of example only.

DETAILED DESCRIPTION OF THE INVENTION

Figure 1:
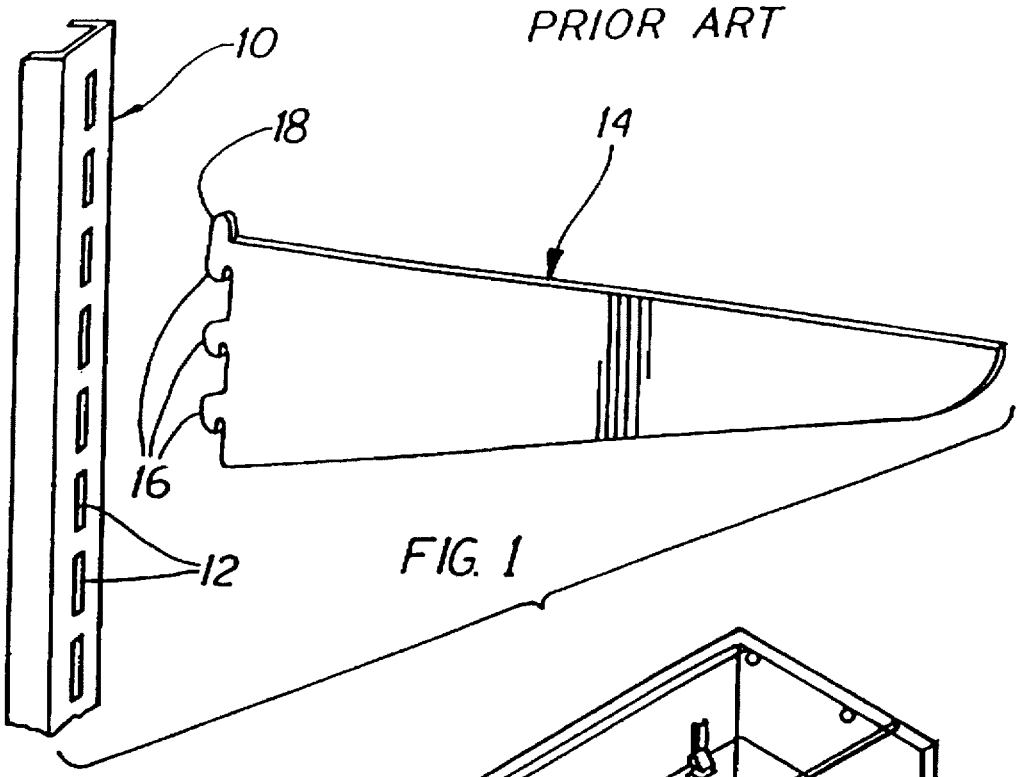
FIG. 1 is an exploded perspective view of a prior art shelving system utilizing a slotted standard.
Figure 2:
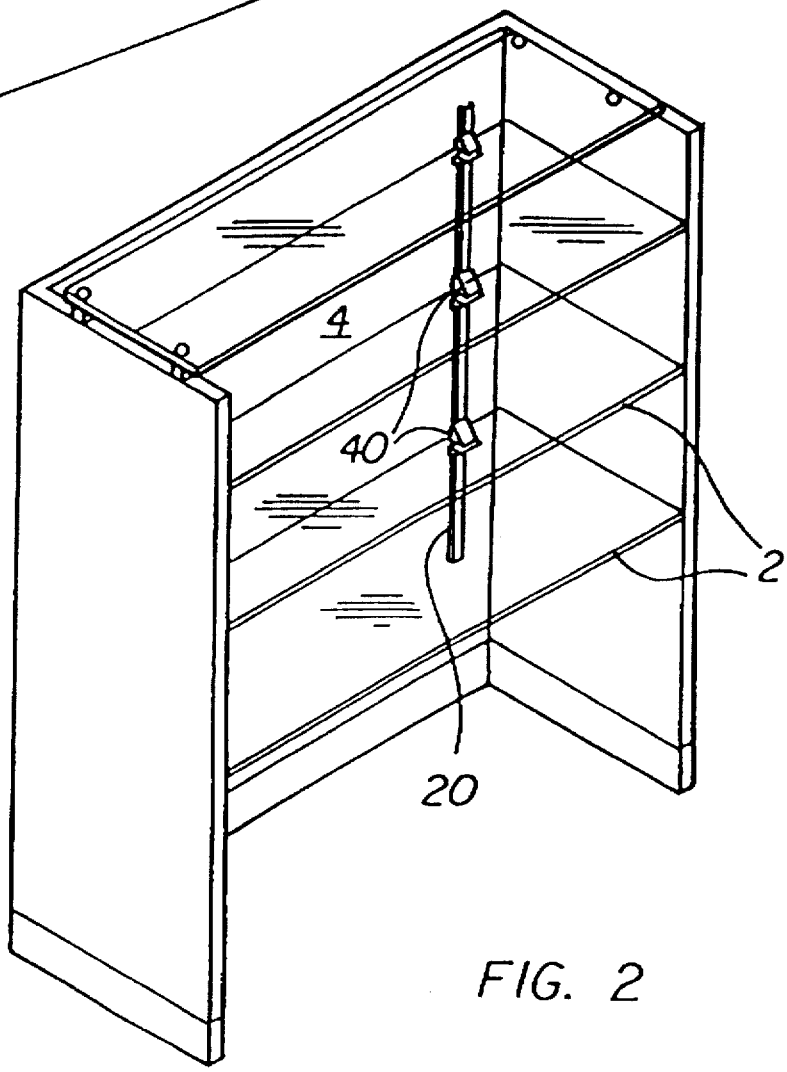
FIG. 2 is a perspective view of a display stand utilizing the standard system of the invention.

FIG. 1 illustrates a conventional slotted standard 10 having a series of evenly spaced slots 12 and hardware such as a typical shelf bracket 14 having hooks 16 dimensioned and spaced to engage the slots 12. The standard 10 is mounted conventionally on or recessed into a vertical supporting surface 4, such as in a display stand of the type illustrated in FIG. 2. The bracket 14 is tilted upwardly and hooks 16 are inserted into the slots 12. When the bracket 14 is dropped to the horizontal the hooks 16 are locked into the standard by the tooth 18. This ensures that the bracket 14 cannot become inadvertently detached from the standard 10. It can be seen that substantial clearance is required above the bracket 14 in order to allow for mounting on and removal from the standard 10. Moreover, once the bracket 14 is mounted on the standard 10 it will seat in a fixed position and its attitude relative to the standard 10 cannot be adjusted.

Figure 3:
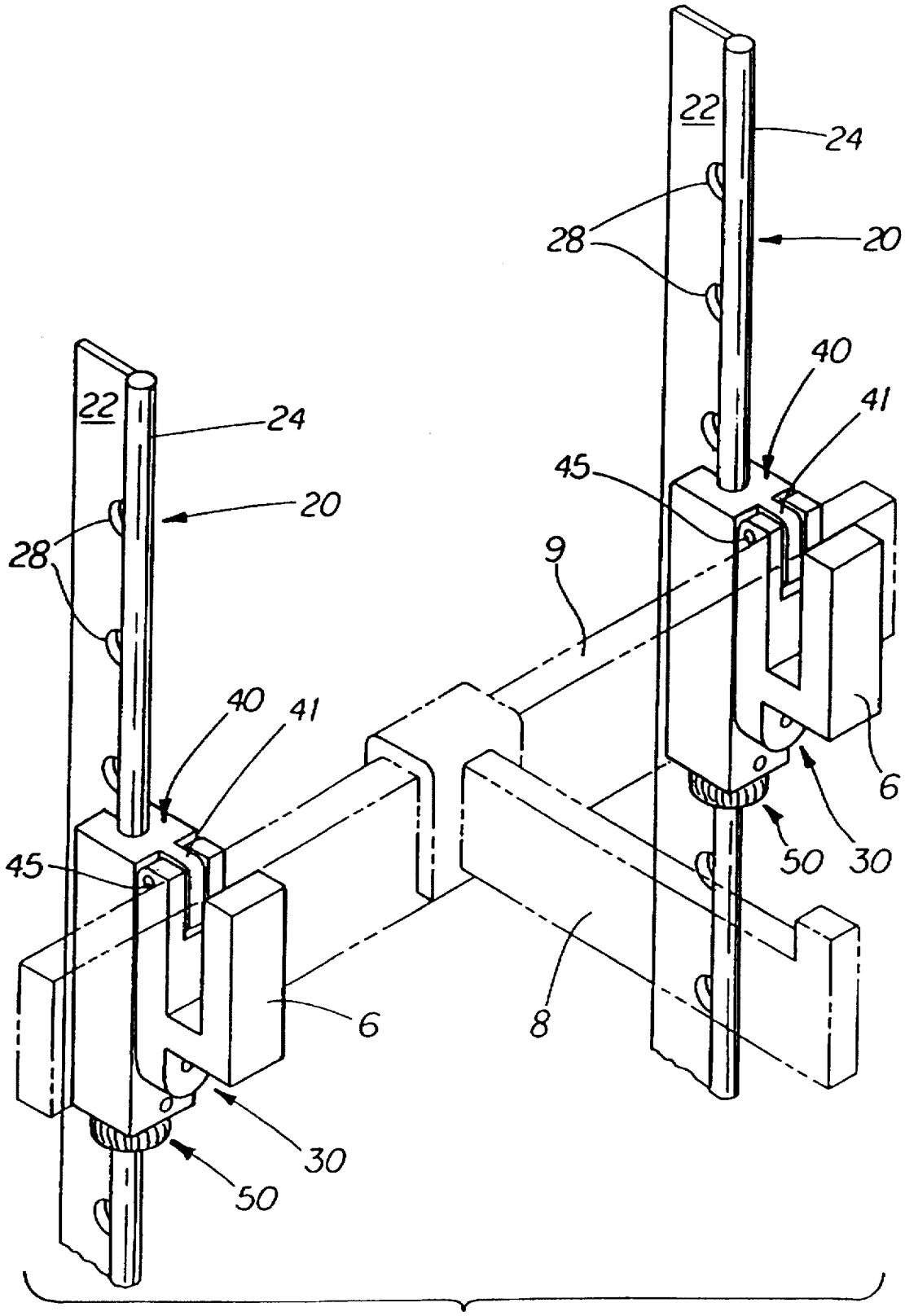
FIG. 3 is a perspective view of one preferred embodiment of the standard system of the invention.
Figure 4:
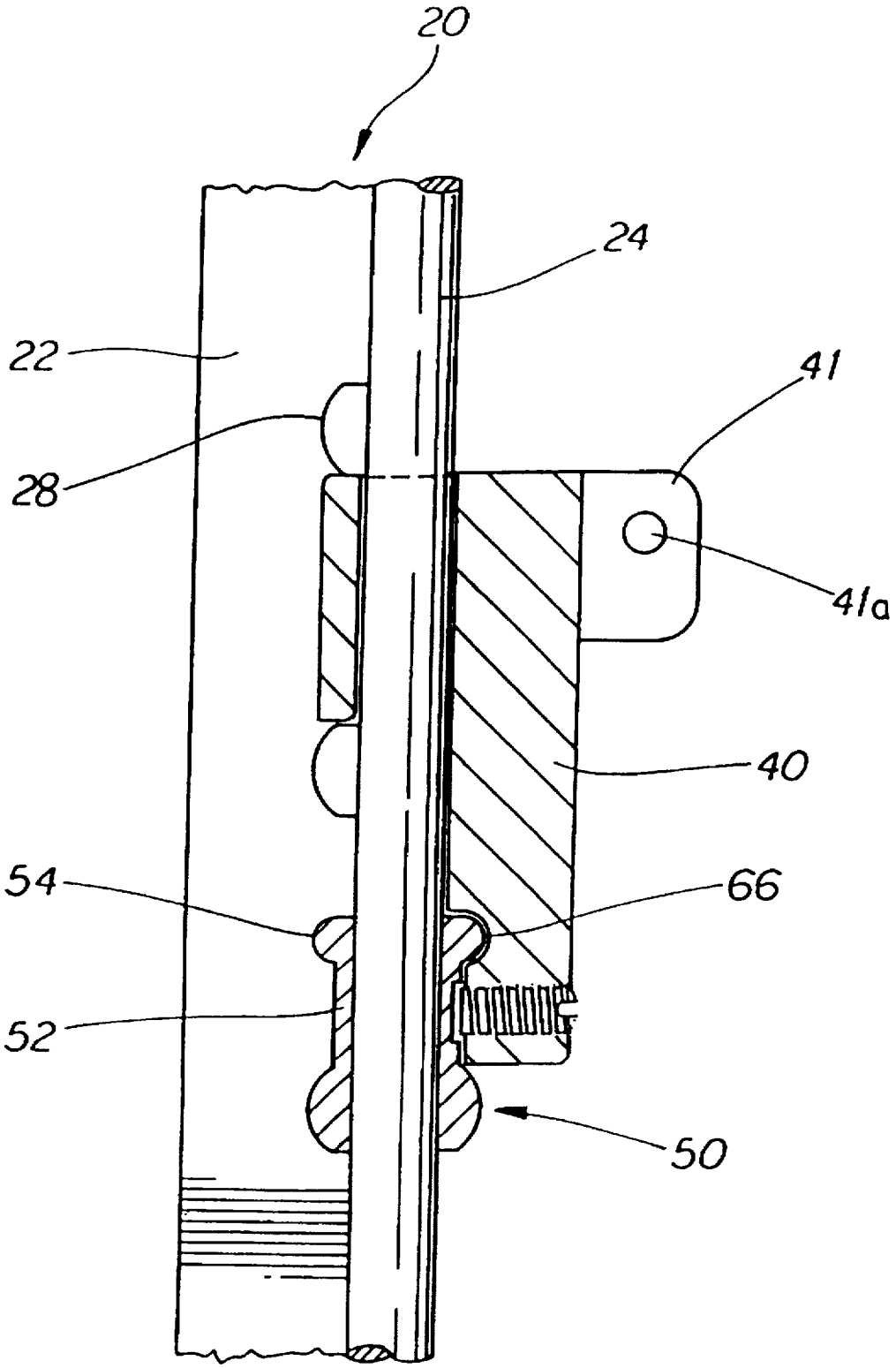
FIG. 4 is a cross sectional elevation of a sliding body engaged about the mounting rail in the standard system of the invention.

FIG. 3 illustrates a preferred embodiment of the adjustable standard system according to the invention. The standard system includes a mounting rail 20 which is mounted in a display or shelving unit or the like, and support means 30 comprising a sliding body 40 to which any suitable configuration of hardware such as a shelf bracket 3, hook 6, hangar 8 or the like is attached.

In a preferred embodiment of the invention the mounting rail 20 comprises a tongue 22 which is essentially a thin, flat metal bar which is thick enough to be rigid, and an enlarged portion which in the embodiments illustrated is in the form of a bead 24 extending substantially along the length of the front edge of the rail 20. The rear edge of the rail 20 is provided with suitable means for mounting the rail 20 on a supporting surface 4. For example, in the embodiment illustrated in FIG. 23 the tongue 22 is formed with hooks 21 configured to hang on a conventional slotted standard 10. It will be appreciated that many other suitable mounting means are available, including a flange mounted by screws, bolts, rivets etc., some of which are shown in FIGS. 24 to 28, and the invention is in no way limited to any particular means for mounting or fastening the mounting rail 20.

The sliding body 40, embodiments of which are illustrated in detail in FIGS. 4 to 8, is provided with means for attaching hardware, for example a shelf bracket 3 for supporting a shelf 2, a hook 6, a hanger 8, or hardware of any other desired configuration. The hardware is supported by the sliding body 40, and in turn supports or suspends articles or supports means for supporting articles such as a shelf 2.

Figure 5A:
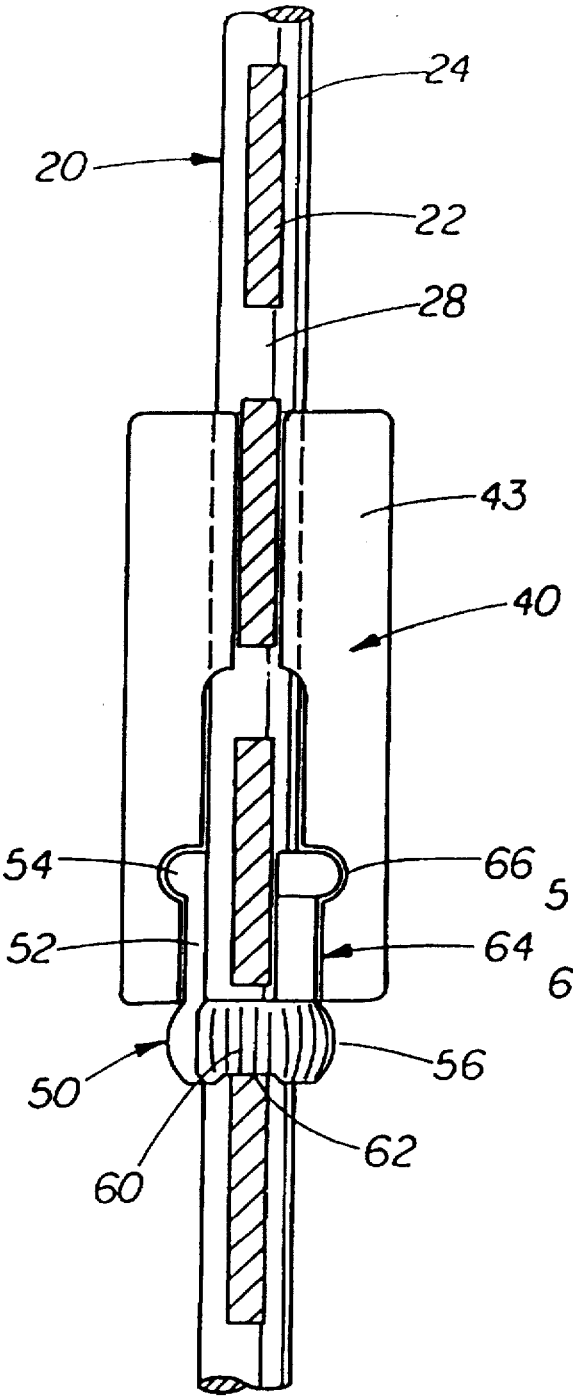
FIG. 5*a* is a rear elevation of the standard system of FIG. 4 showing the latch of the locking ring engaged to the mounting rail.
Figure 5B:
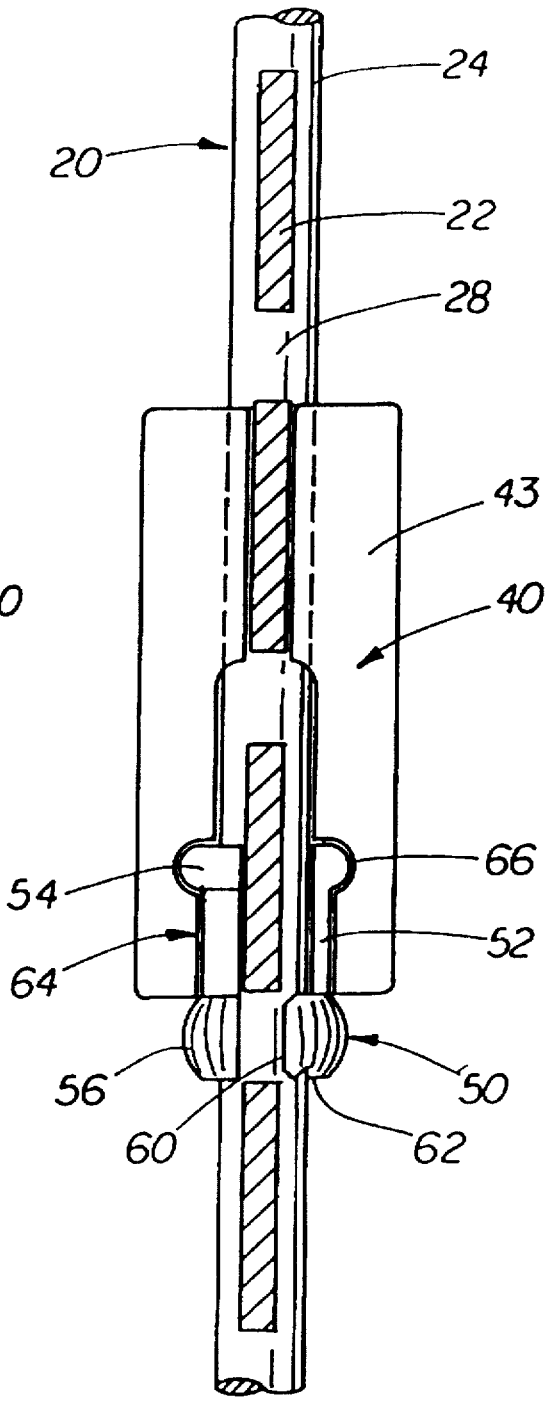
FIG. 5*b* is a rear elevation of the standard system of FIG. 3 showing the latch of the locking ring disengaged from the mounting rail.
Figure 6:
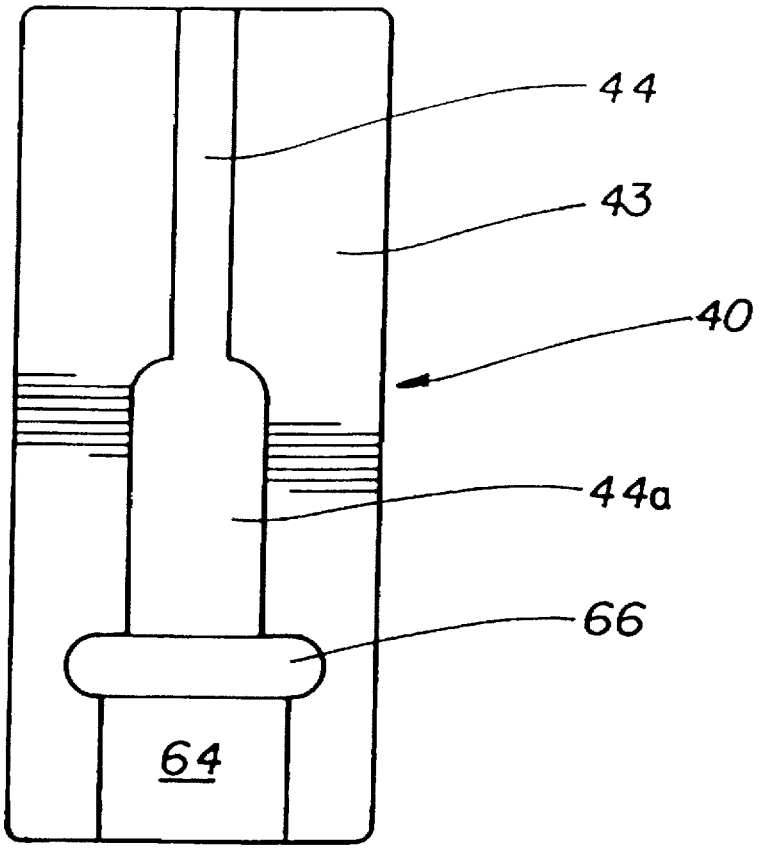
FIG. 6 is a rear elevation of the sliding body of FIG. 4.
Figure 13:
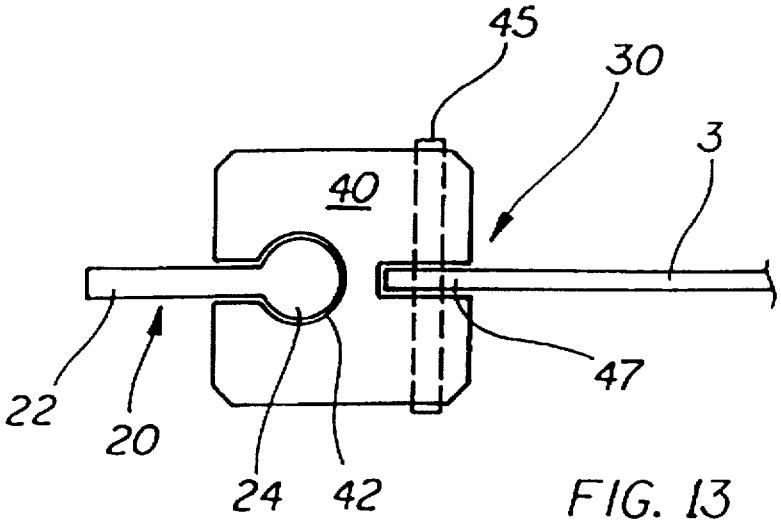
FIG. 13 is a top plan view of the embodiment of FIG. 12.
Figure 14:
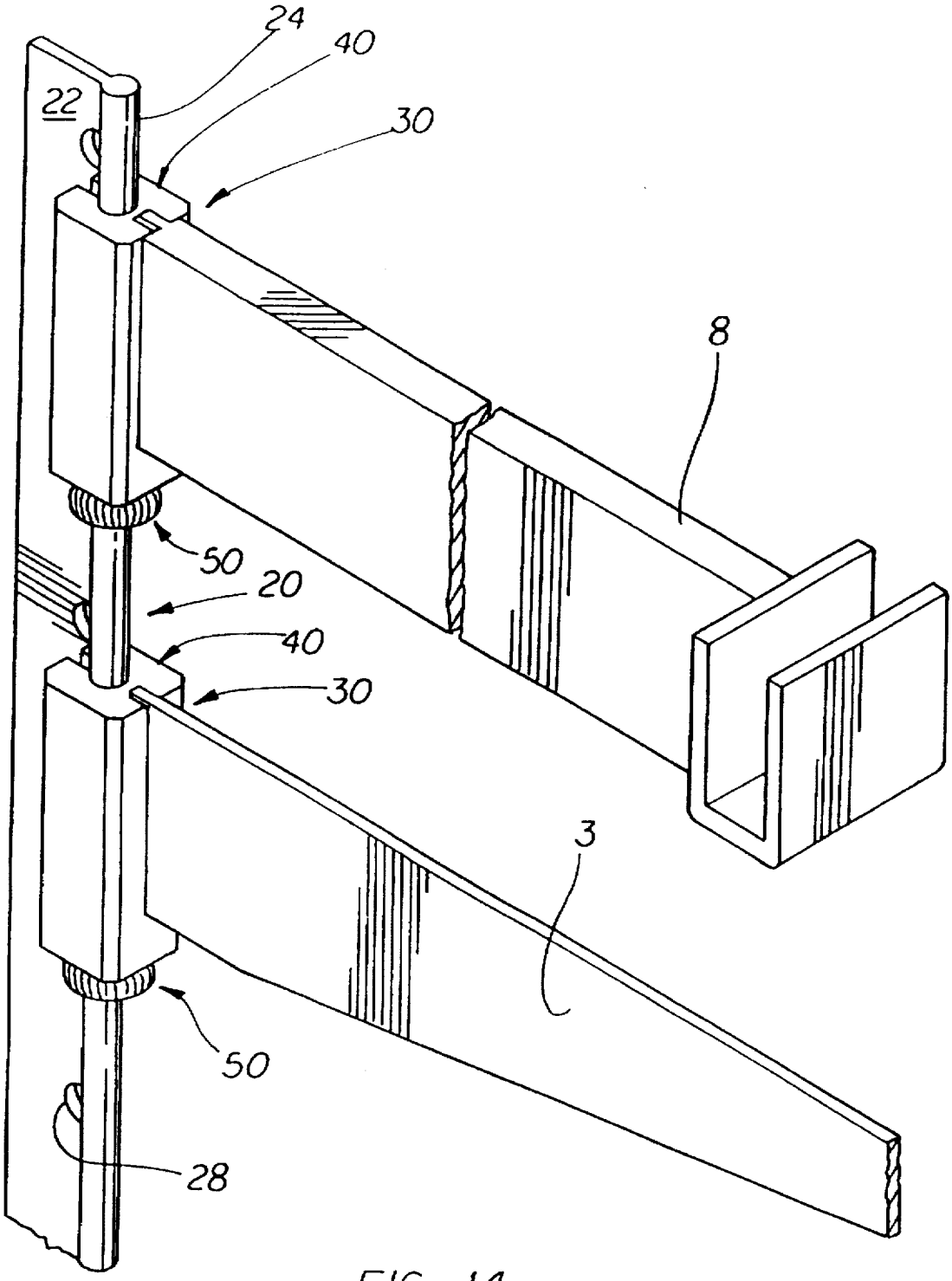
FIG. 14 is a perspective view of the embodiment of FIG. 12 having an adjustable hangar bar hook and shelf bracket.
Figure 15:
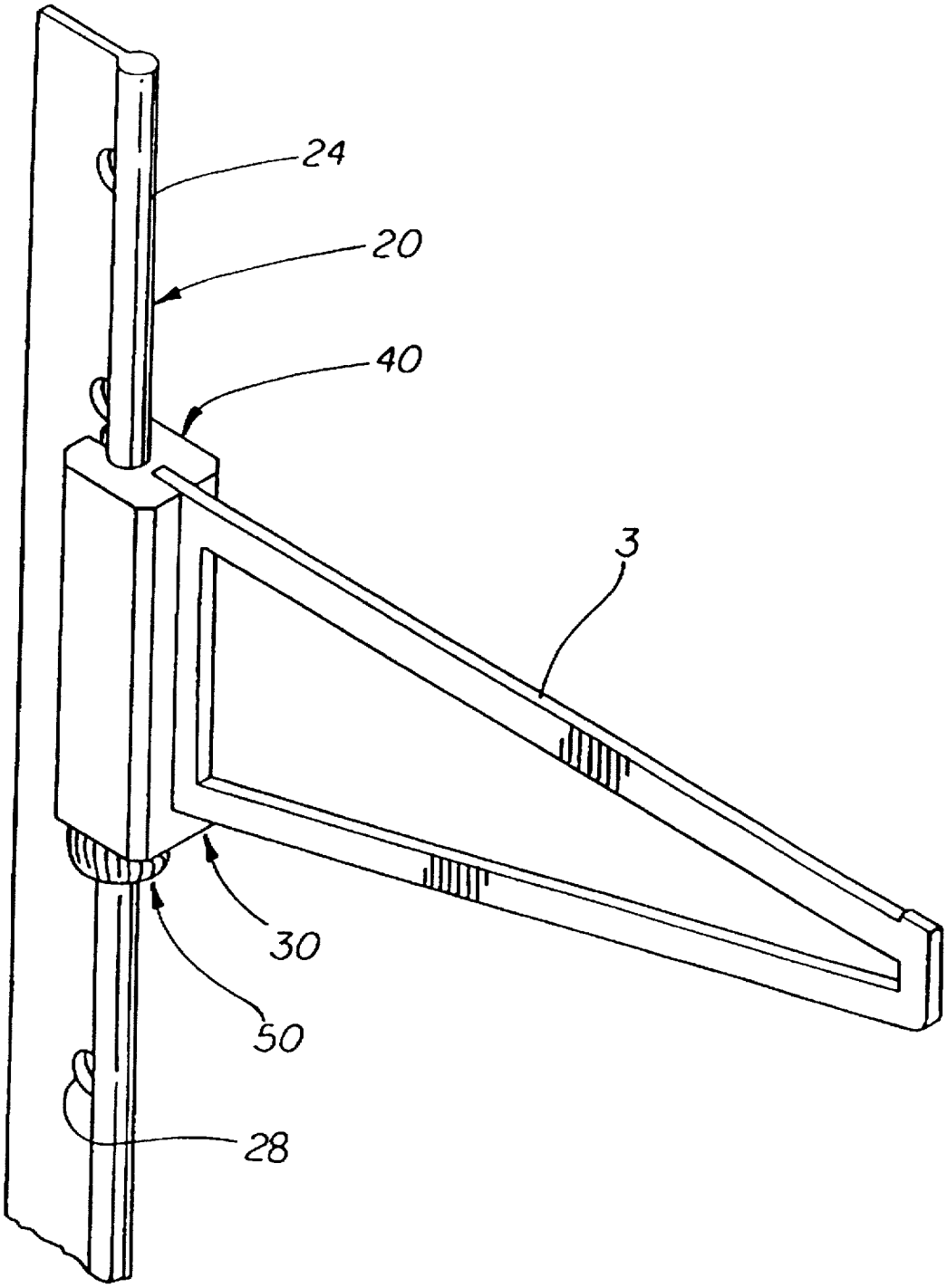
FIG. 15 is a perspective view of the embodiment of FIG. 12 having an adjustable decorative shelf bracket.

In a preferred embodiment the body 40 is provided with a keyhole-shaped channel 42, best seen in FIG. 13, including an enlarged portion wide enough to permit the bead 24 to slide relatively freely through the body 40 and a narrow portion through which the tongue 22 of the rail 20 is disposed when the body 40 is engaged to the rail 20. The narrow portion of the channel 42 extends through the rear wall 43 of the body 40 to form a slot 44 extending transversely into the body 40 through the rear wall 43, as seen in FIG. 6. The tongue 22 of the mounting rail 20 extends through this slot 44 when the body 40 is engaged over the rail 20, but the slot 44 is too narrow to allow the bead 24 to pass through, as can be seen in FIGS. 5*a* and 5*b*. Thus, when the sliding body 40 is mounted over the bead 24 on the mounting rail 20, the sliding body 40 cannot be detached from the mounting rail 20 but can slide freely up and down the rail 20.

It will be appreciated that the enlarged portion of the channel 42 is circular in cross section in the embodiment illustrated only because the bead 24 has a circular cross section. The mounting rail 20 could as readily be provided with an enlarged portion 24 that is rectangular, triangular, oval, chevron, T-shaped, or any other shape, so long as it is expanded in thickness relative to the thickness of the tongue 22, and the channel 42 would be provided with a complimentary configuration. Also, the enlarged portion 24 need not be disposed along the front edge of the rail 20, but can be recessed somewhat onto the tongue 24, although in practice it may be more economical and aesthetically appealing to form the rail 20 with the enlarged portion 24 along its front edge.

Locking means comprises a latch projecting from the sliding body 40, for fixing the support means 30 to the mounting rail 20 at a selected position. In the preferred embodiment locking means comprises a locking ring 50, illustrated in FIG. 7, rotatably lodged in a cavity 64 formed in a lower portion of the body 40. The locking ring 50 comprises a constricted cylindrical body 52 terminating at its upper end in an annular lip or collar 54 and provided at its lower end with a ribbed or knurled dial 56. The cavity 64 has a furrow 66 into which the collar 54 of the locking ring 50 seats in the manner shown in FIGS. 4 and 5, preventing the locking ring 50 from sliding axially within the body 40 but allowing the locking ring 50 to be rotated within the cavity 64.

Figure 7:
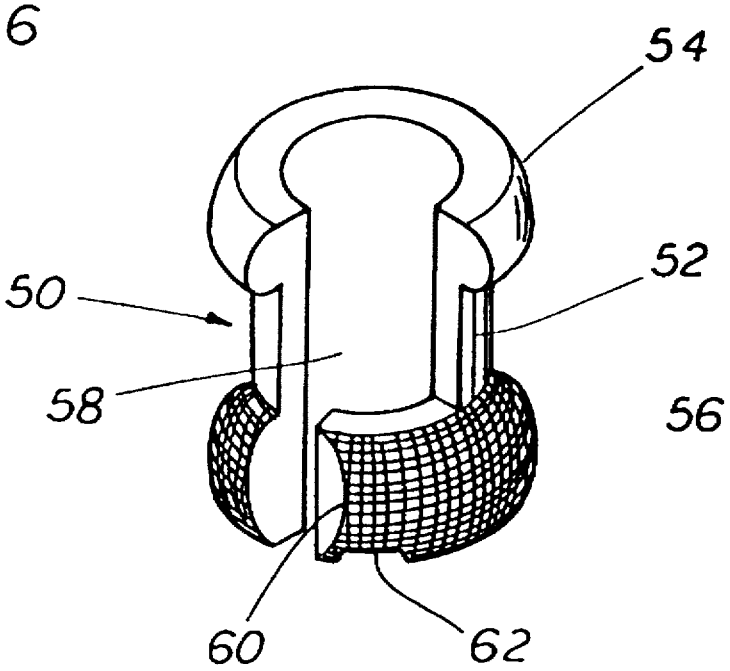
FIG. 7 is a perspective view of the locking ring.

As seen in FIG. 7, the locking ring 50 also has a longitudinal slot 58 extending along its entire height, through which the tongue 22 of the mounting rail 20 extends, while the bead 24 is disposed through the hollow centre of the locking ring body 52. The dial 56 is provided with a latch 60 in the form of a projection or protuberance that extends into the slot 58 generally following the curvature of the dial 56. The latch 60 is configured so as to fit into one of a series of openings 28 provided in the tongue 22 of the rail 20 immediately behind the bead 24.

The dial 56 projects down below the bottom of the body 40, exposed for manual rotation, and is ribbed or knurled to assist a user in gripping and rotating the locking ring 50. A shallow detent 62 is disposed along the bottom edge of the latch 60, to engage the edge of an opening 28 and thus resist rotation of the locking ring 50.

Thus, when the sliding body 40 is engaged to the rail 20 with the locking ring 50 lodged in the cavity 64, the locking ring 50 can be rotated between a position in which the latch 60 is engaged through an opening 28 in the mounting rail 20 (FIG. 5*a*) and a position in which the latch 60 is disengaged from the opening 28 in the mounting rail 20 (FIG. 5*b*). This allows the sliding body 40 to be selectively fixed to the mounting rail 20 in any position at which there is an opening 28. The openings 28 in the mounting rail 20 can be semi-circular, circular, square, triangular or any other shape which does not detract from the strength of the mounting rail 20.

The slot 58 must be wide enough that the tongue 22 of the mounting rail 20 can fit between the free end of the latch 60 and the opposing edge of the slot 58, so that when the latch 60 is disengaged from an opening 28 in the rail 20 the sliding body 40 can slide freely along the rail 20.

Figure 17:
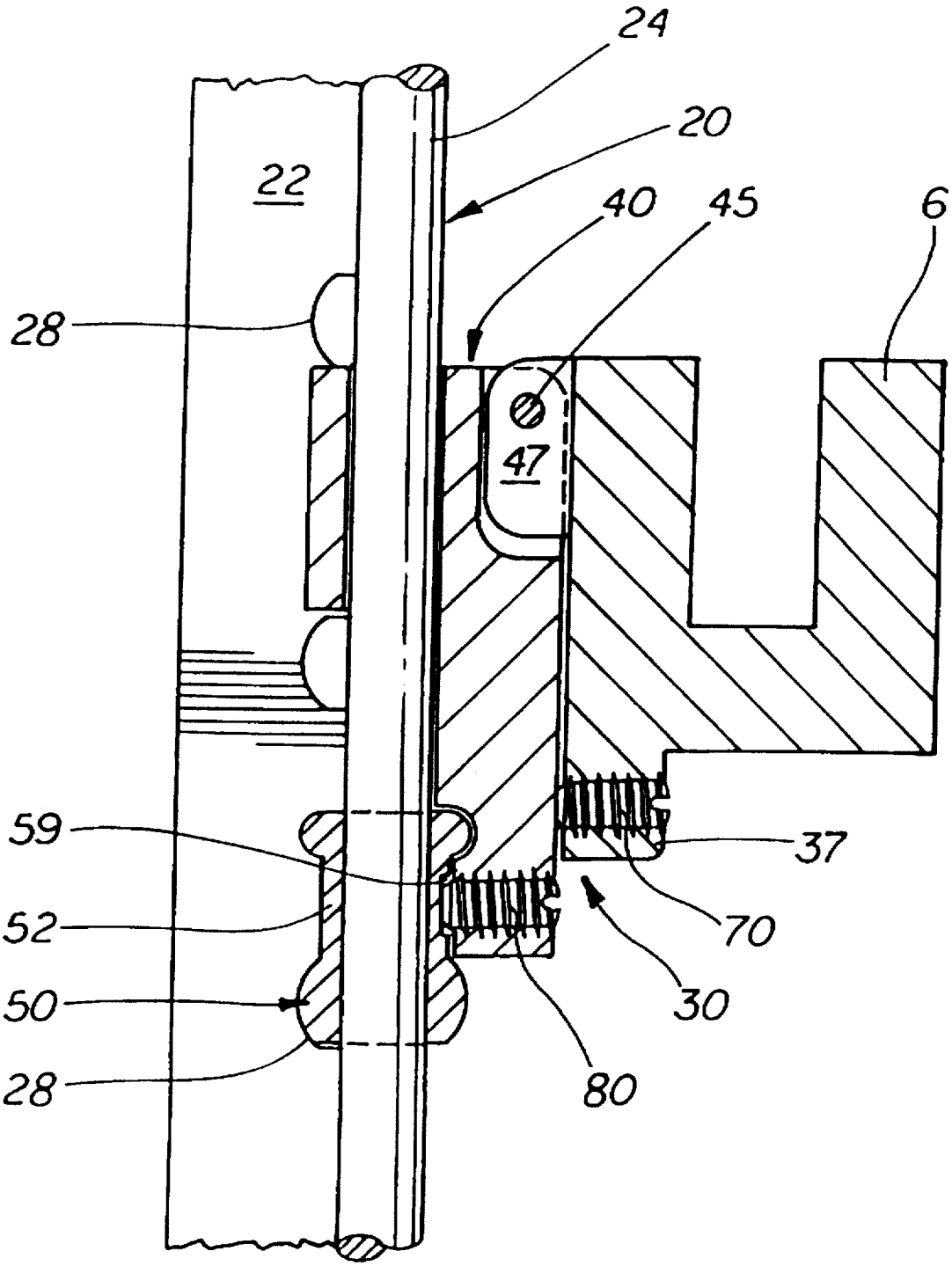
FIG. 17 is a sectional side elevation of a still further embodiment of the invention having an adjustable U-hook.
Figure 18:
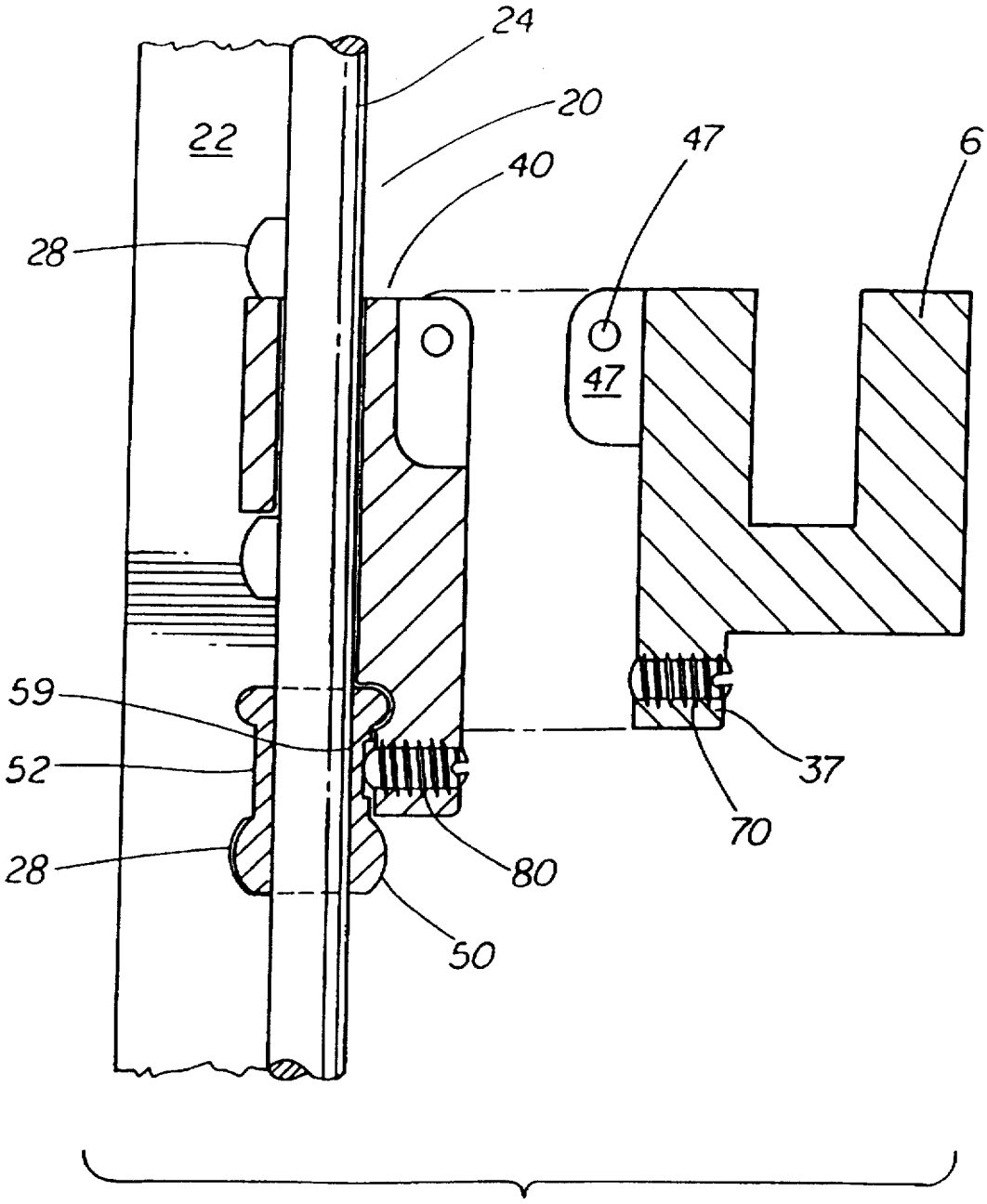
FIG. 18 is a partially exploded sectional elevation of the embodiment of FIG. 15.
Figure 19:
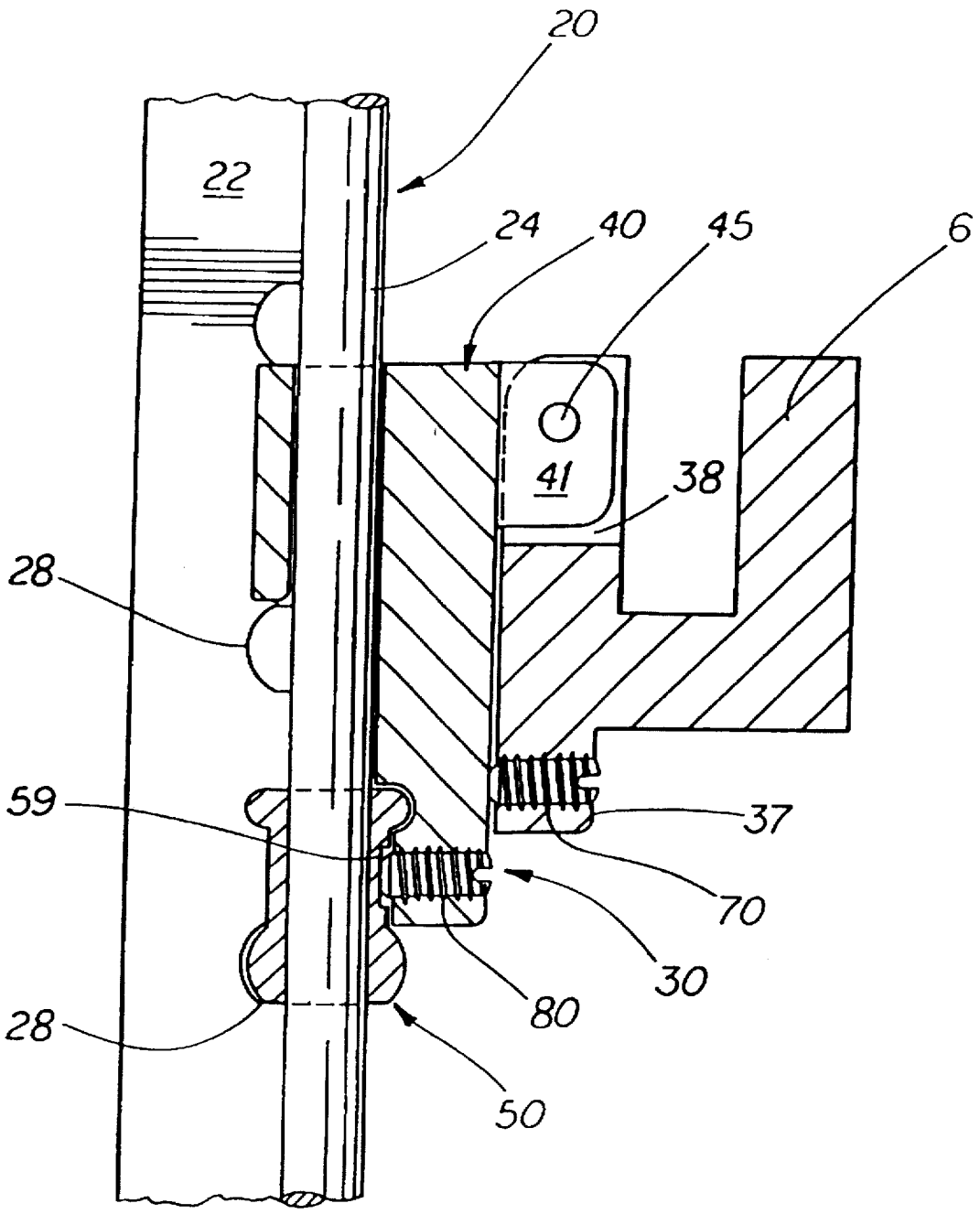
FIG. 19 is a sectional side elevation of a variation of the embodiment of FIG. 15.

In the embodiments illustrated in FIGS. 17 to 19, a locking screw 80 is threaded through a hole in the lower end of the body 40 extending to the cavity 64, to lock the latch 60 in the opening 28. The body 52 of the locking ring 50 is provided with a hole or recess 59 in diametric opposition to the latch 60. Thus, when the locking ring 50 is rotated so that the latch 60 engages an opening 28 in the rail, the hole or recess 59 is aligned with the locking screw 80. When the screw 80 is driven into the body 40 the foot of the screw 80 engages the hole or recess 59, preventing rotation of the locking ring and thereby preventing inadvertent disengagement of the latch 60 from the mounting rail 20.

Figure 8:
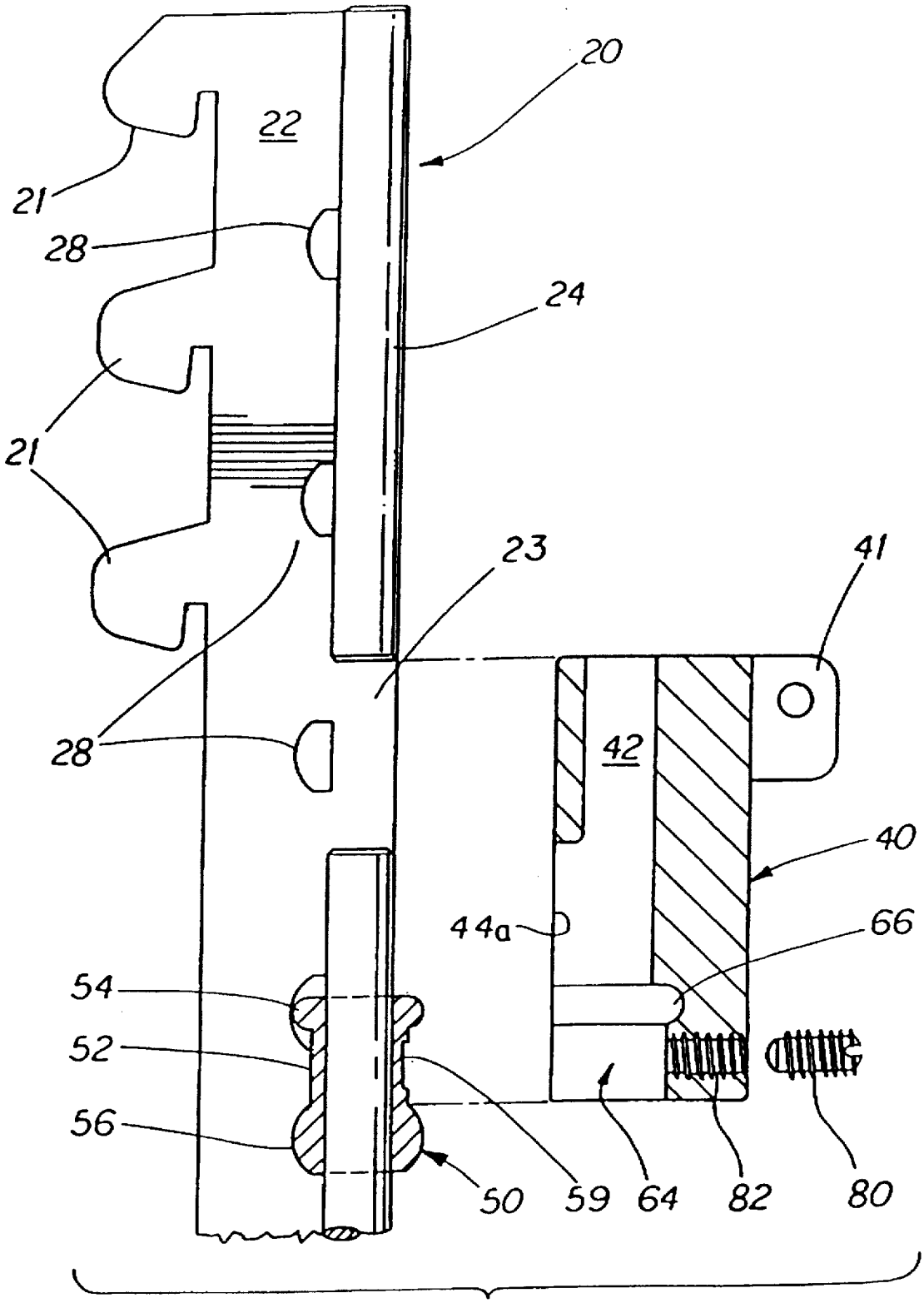
FIG. 8 is a partially exploded sectional elevation showing the manner of engaging the sliding body of FIG. 4 onto a gap in the bead of the mounting rail.

A widened portion 44*a* of the slot 44 in the rear face 43 of the body 40, best seen in FIG. 6, allows the sliding body 40 to be mounted onto the mounting rail 20 through a small gap 23 in the bead 24, which may be provided for example near the top of the mounting raft 20 as shown in FIG. 8. The bead 24 will traverse the widened portion 44*a* of the slot 44 from behind the body 40, as can be seen in FIGS. 5*a* and 5*b*, so the gap 23 need be only as long as the narrow portion of the slot 44. This enables additional support means 30 to be engaged to or removed from a mounting rail 20 that extends fully between the floor and ceiling of a display or shelving unit, without first detaching the mounting rail 20.

Figure 23:
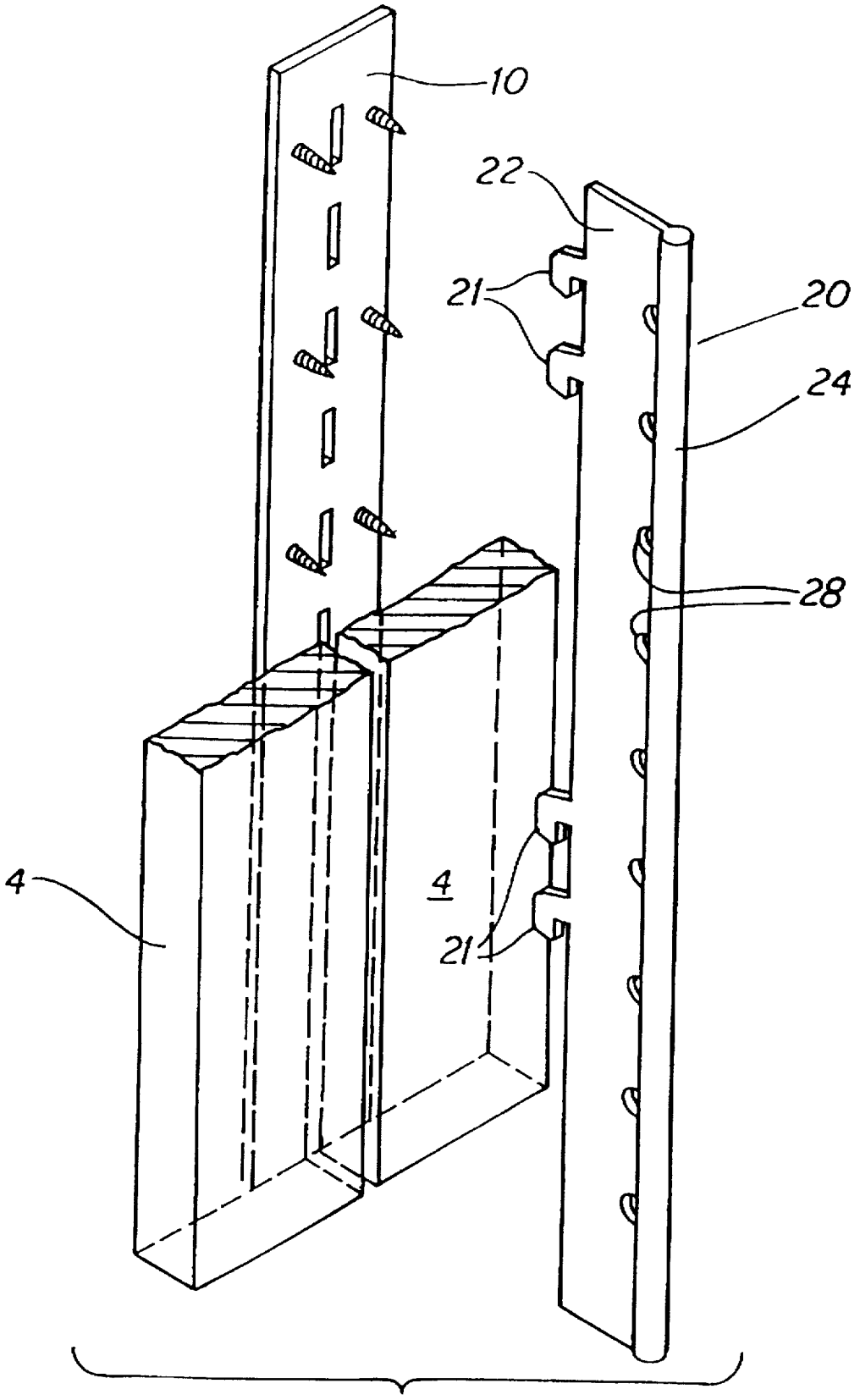
FIG. 23 is a partially cutaway perspective view of the mounting rail of the invention positioned for mounting on a slotted standard recessed into a supporting surface in a display unit.
Figure 24:
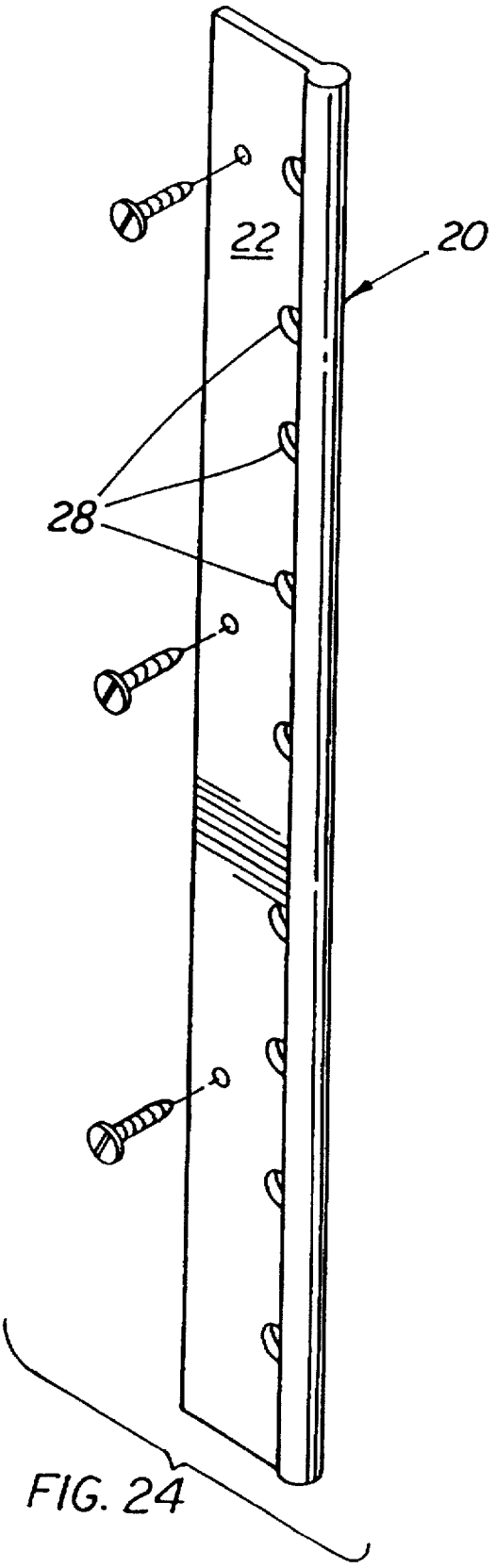
FIG. 24 is a perspective view of a configuration of the mounting rail of the invention adapted to be mounted to the side of a stud in a supporting frame.
Figure 25:
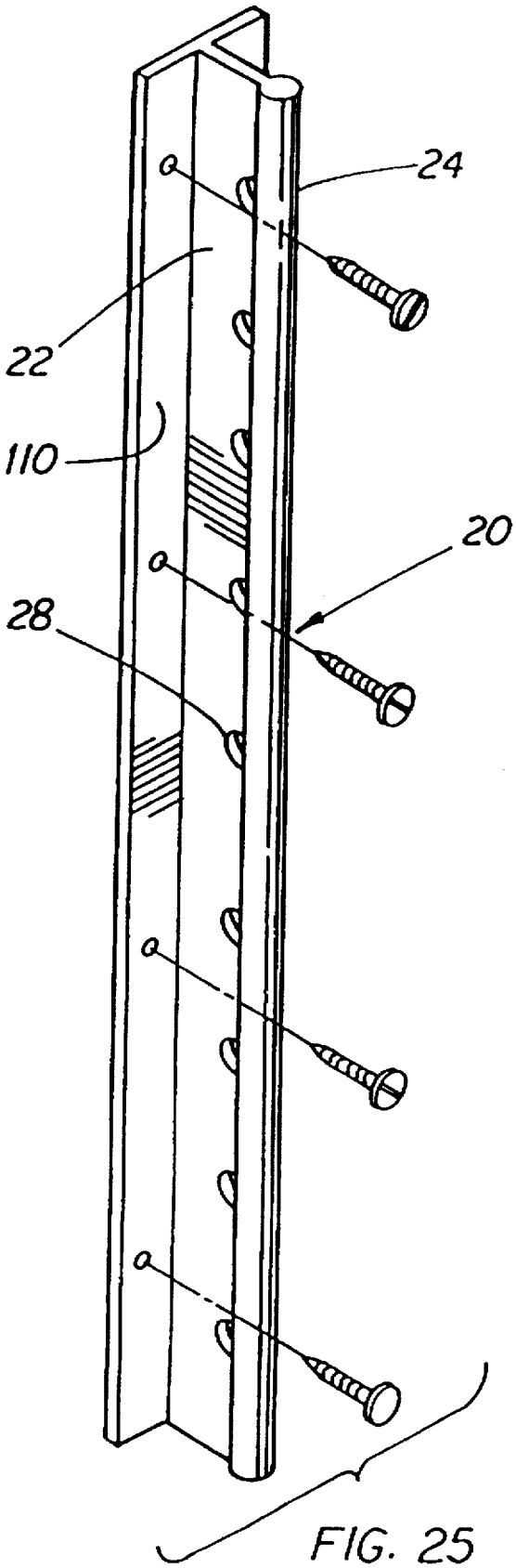
FIG. 25 is a perspective view of a configuration of the mounting rail of the invention adapted to be mounted to the front of a stud in a supporting frame.
Figure 26:
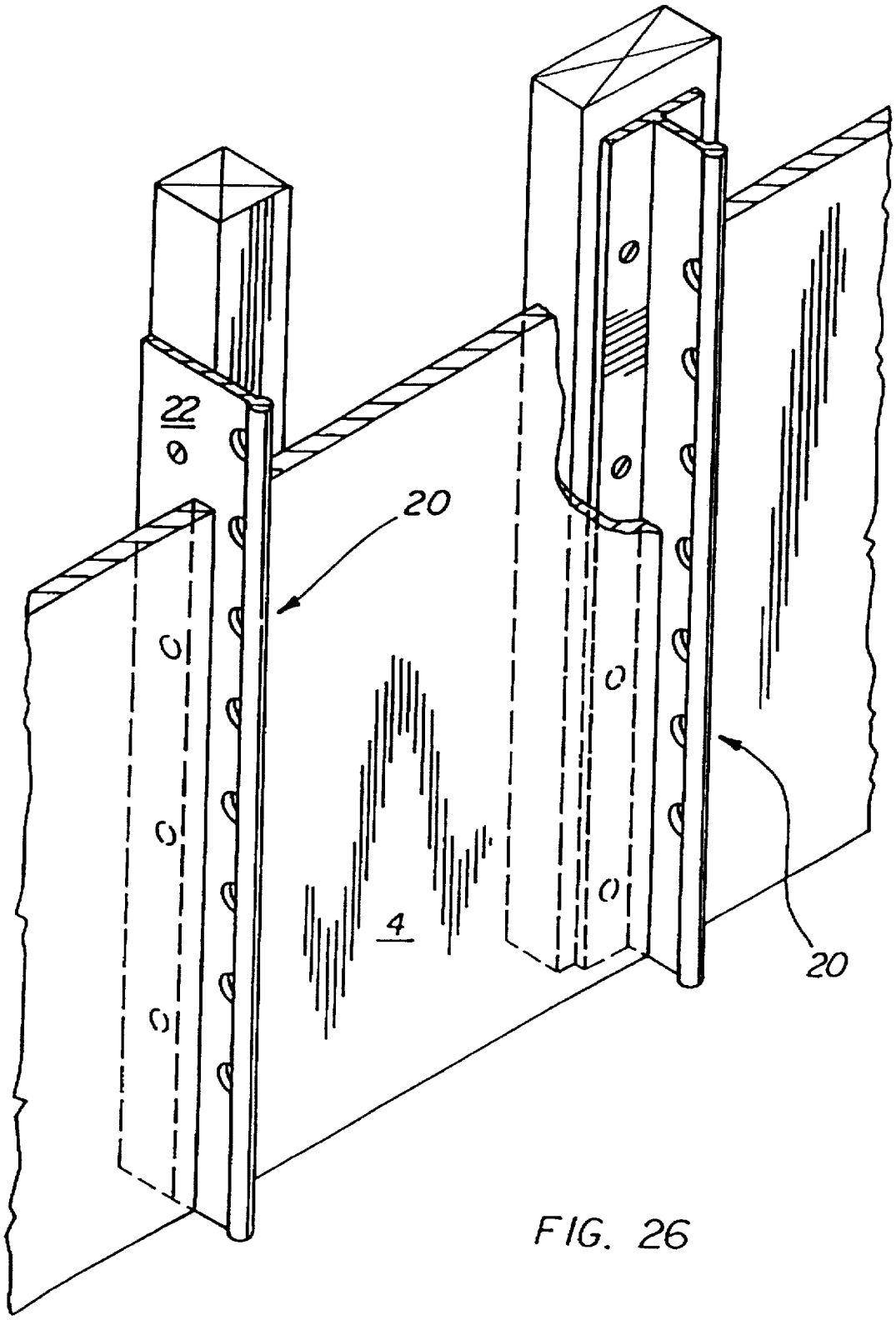
FIG. 26 is a perspective view of showing the mounting rails of FIGS. 24 and 25 mounted on a supporting frame.
Figure 27:
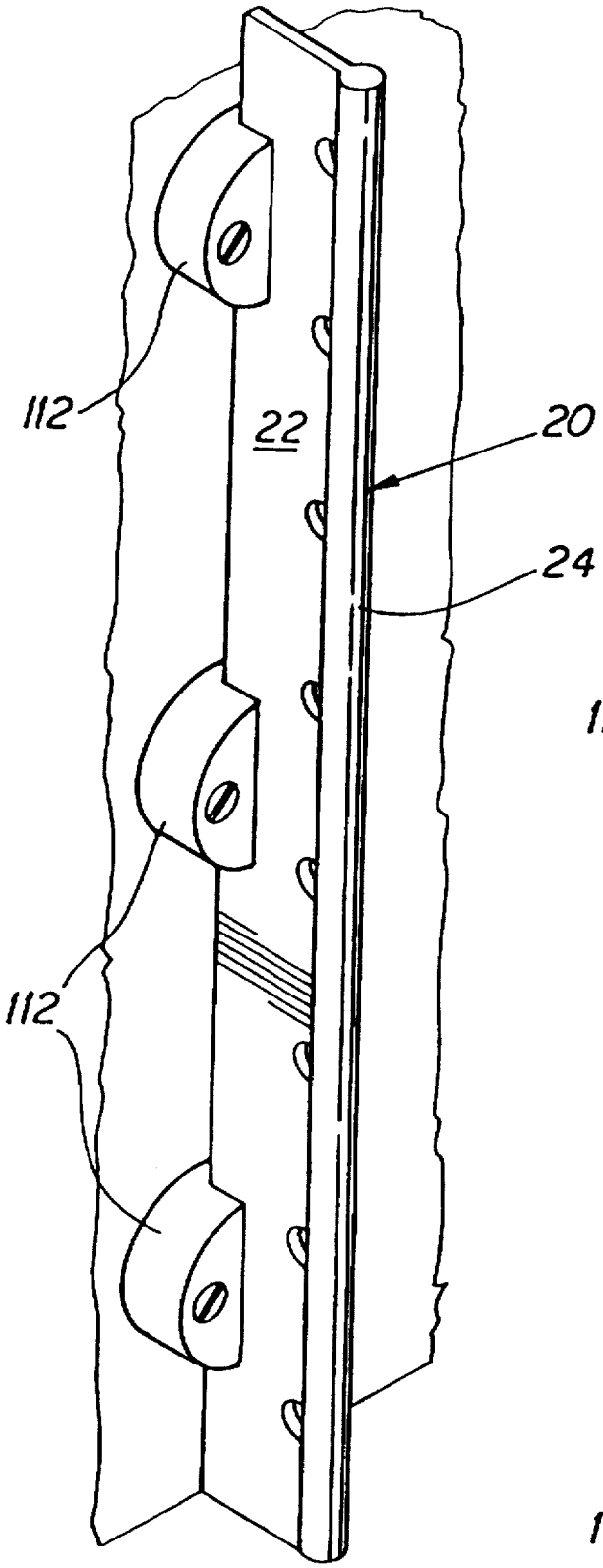
FIG. 27 is a perspective view of a further configuration of the mounting rail of the invention adapted to be mounted perpendicular to a supporting surface.
Figure 28:
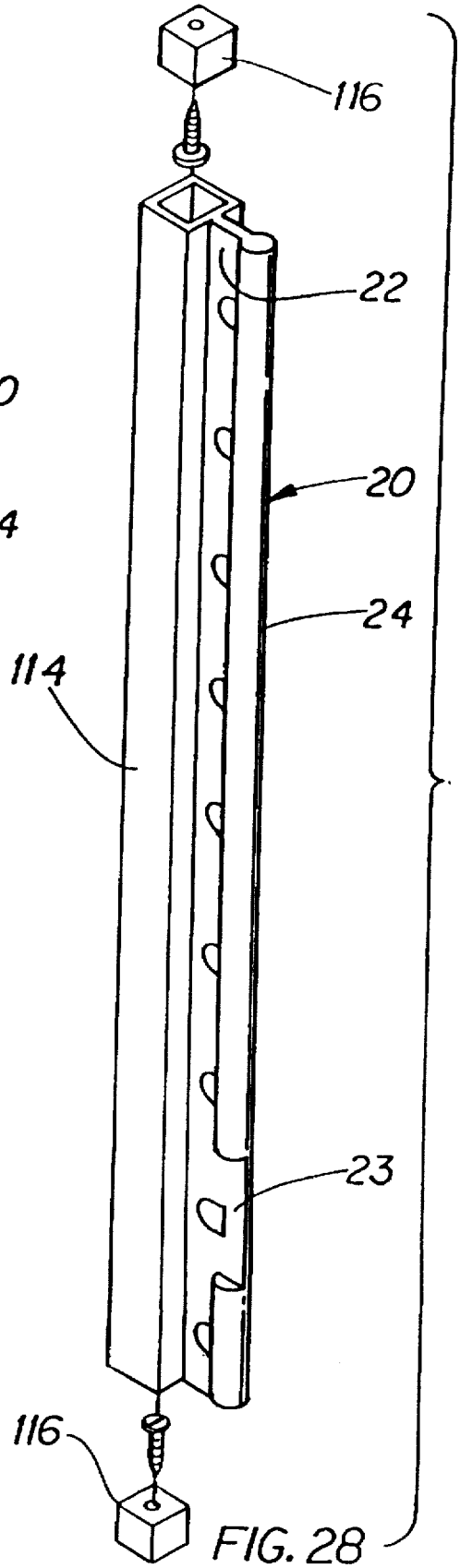
FIG. 28 is a perspective view of the mounting rail of the invention configured for mounting between horizontal surfaces such as the ceiling and floor of a display or shelving unit.

In use, the mounting rail 20 is mounted to the supporting surface 4. As noted above, this can be accomplished in a number of ways. For example, FIG. 23 shows a mounting rail 20 positioned for mounting onto a slotted standard 10 using suitably designed hooks 21. The slotted standard 10 is fastened to the back face of the supporting surface 4, and a separation is provided in the supporting surface 4 through which the hooks 21 on the mounting rail 20 can access the slots in the slotted standard 10. In another embodiment the mounting rail 20 can be mounted to studs in the wall of a display unit using screws, bolts etc. as shown in FIG. 26, either through holes along the rear edge of the mounting rail (FIG. 24) or through holes provided in a flange 110 (FIG. 25) or tabs 112 (FIG. 27) formed perpendicular to the rail 20.

Where structural or aesthetic considerations do not permit the mounting rail 20 to be mounted against a vertical surface or frame, the mounting rail can be formed with or welded to a post in the form of a pipe 114, which is retained in a substantially vertical orientation by end plugs 116 affixed to the floor and ceiling of a display or shelving unit, as in the mounting rail 20 shown in FIG. 29.

To engage the sliding body 40 to the mounting rail 20, a locking ring 50 is inserted over the mounting rail 20 at the gap 23 and lowered slightly until it is engaged about the bead 24 at approximately the position shown in FIG. 8. With the slot 44 aligned with the gap 23, a sliding body 40 is inserted horizontally over the locking ring 50 and onto the mounting rail 20, ensuring that the locking ring 50 properly lodges in the cavity 64 with the collar 54 nested in the furrow 66. Once the body 40 is engaged about the mounting raft 20 the locking ring 50 cannot become detached from the body 40. The locking ring 50 is rotatably engaged in the cavity 64 and prevented from vertical movement relative to the body by the collar 54 nesting in the furrow 66. The sliding body 40 can then be slid up or down the rail 20, with the bead 24 extending through the channel 42 through the body 40 and the hollow body 52 of the locking ring 50.

When the desired height is reached the user grasps the dial 56 and rotates the locking ring 50 to engage the latch 60 into the nearest opening 28, as in FIG. 5*a*. The detent 62 engages the bottom edge of the opening 28, which helps to prevent disengagement of the latch 60 from the opening 28. The locking screw 80 would then be tightened to lock the locking ring 50 in position. To move the sliding body 40 to a new position, the user loosens the locking screw 80, applies a slight upward pressure to release the detent 62 from the edge of the opening 28 and turns the dial 56 to rotate the locking ring 50 in the opposite direction, releasing the latch 60 from the opening 28, as shown in FIG. 5*b*, so that the sliding body 40 can slide freely along the rail 20.

Figure 9:
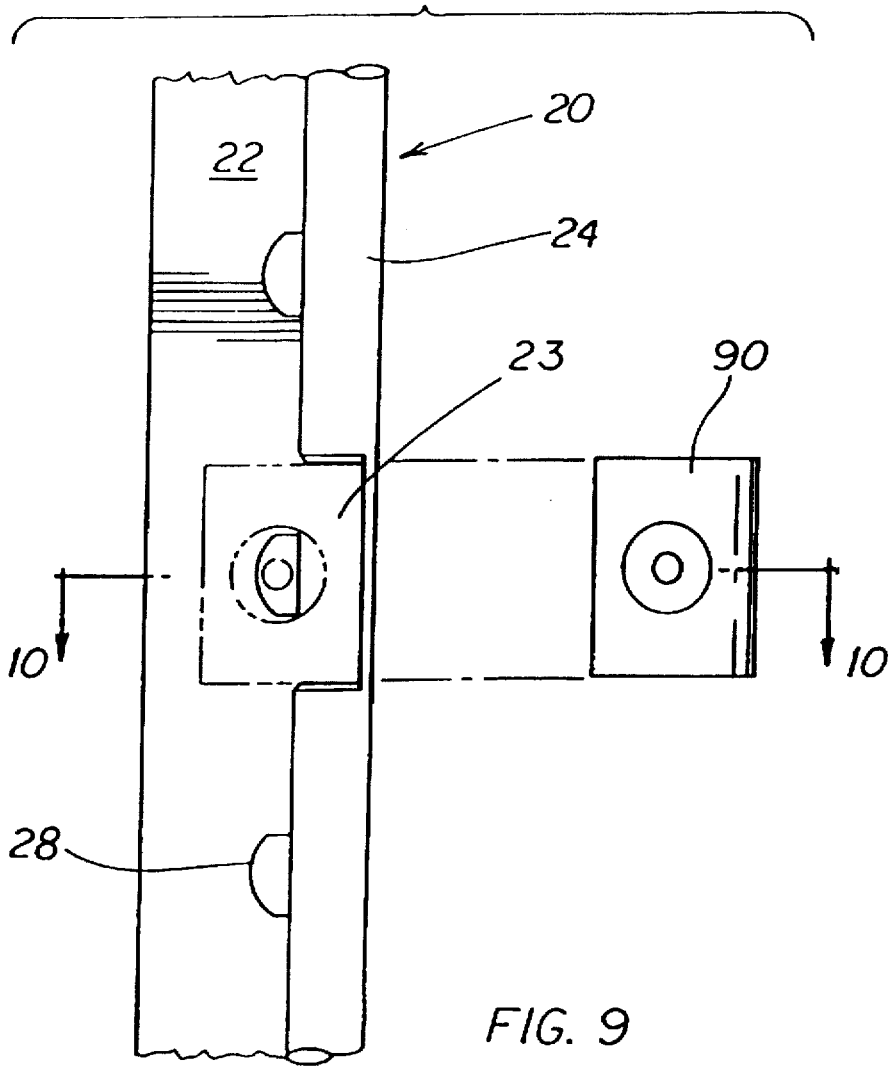
FIG. 9 is a side elevation of a plug for closing the gap shown in FIG. 8.
Figure 10:
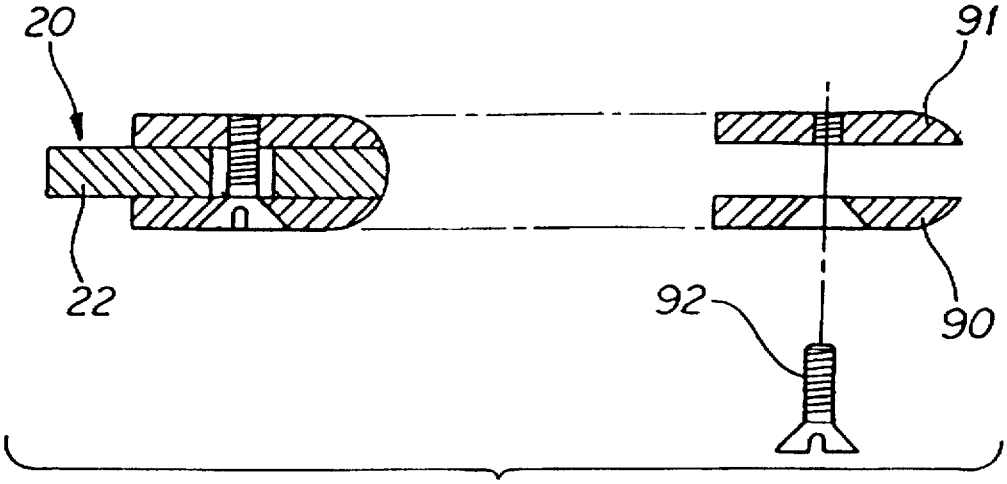
FIG. 10 is a cross section taken along the line 10—10 in FIG. 9.
Figure 11:
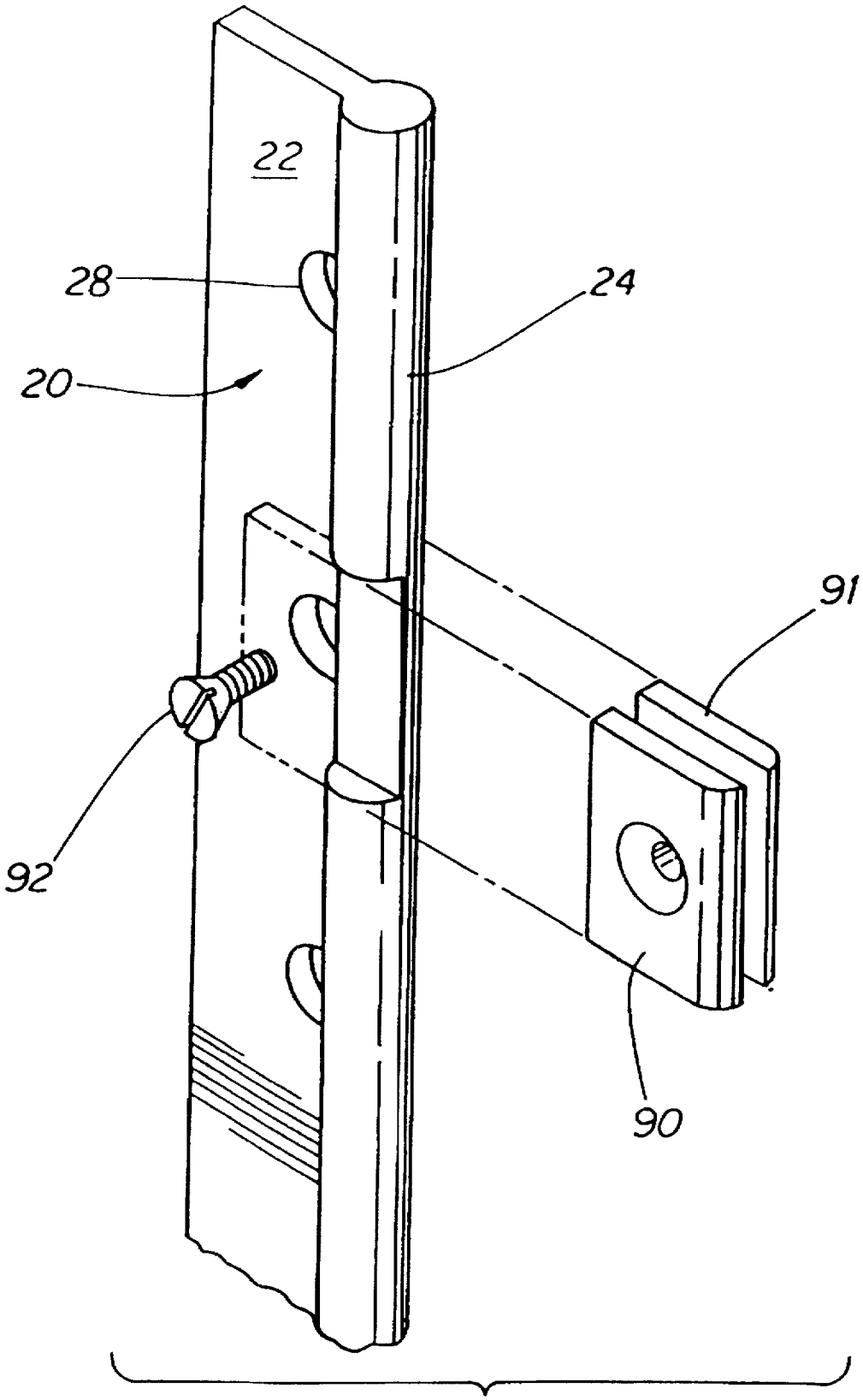
FIG. 11 is a perspective view of FIG. 9.

When the required number of sliding bodies 40 has been loaded onto the mounting rail 20, the gap 23 may be dosed off by plugs 90, 91, as illustrated in FIGS. 9 to 11. Thus, the gap 23 is preferably positioned immediately adjacent to an opening 28. The plug 90 has a countersunk hole for a screw 92, and the plug 91 has a threaded hole, so that when the holes in the plugs 90, 91 are aligned with the opening 28 and the screw 92 is engaged as shown in FIG. 10, the gap 23 is dosed and sliding bodies 40 cannot be removed from the rail 20. It will be noted that the sliding bodies 40 will not slide past the plugs 90, 91, and therefore to avoid limiting the positions to which the sliding bodies 40 can be adjusted it will generally be preferable to provide the gap 23 either near the top or near the bottom of the rail 20.

The standard system of the invention thus allows for easy rearrangement of hardware by a single user, who can both hold up the supporting structure and rotate the locking ring to release the latch 60 with one hand. Moreover, as no tilting of the hardware is required to change its position on the rail 20, this can be accomplished without removing the articles from the supporting structure, for example a shelf 2.

In the embodiments described above hardware such as brackets 3 for supporting shelves 2, hooks 6, hangars 8 and the like for supporting or suspending articles, are each pivotally attached to the sliding body 40. The body 40 may be provided with a projecting bracket or tab 41 having a hole 41*a*, as in the embodiment illustrated in FIG. 19, and the hardware is provided with a recess 38 into which the tab 41 is inserted and a complimentary hole. Alternatively, the body 40 may be provided with a recess 39 into which a projecting portion or tab 47 of the hardware having a hole 47*a* extends, as in the embodiments illustrated in FIGS. 12 to 18, and the body 40 is provided with a complimentary hole. A pin or rivet 45 extends through these holes to pivotally attach the hardware to the body 40, and the sliding body 40 thus supports the hardware.

Because the hardware is pivotally attached to the top of the body 40, the lower end of the bracket 3, hook 6, hangar 8 or other hardware will pivot toward and away from the mounting rail 20 and gravity will force the hardware to the lower limit of its pivoting motion. Thus, the sliding body 40 is provided with adjusting means, for example a threaded adjusting screw 70 disposed through a hole 72 in the lower end of the body 40.

Figure 12:
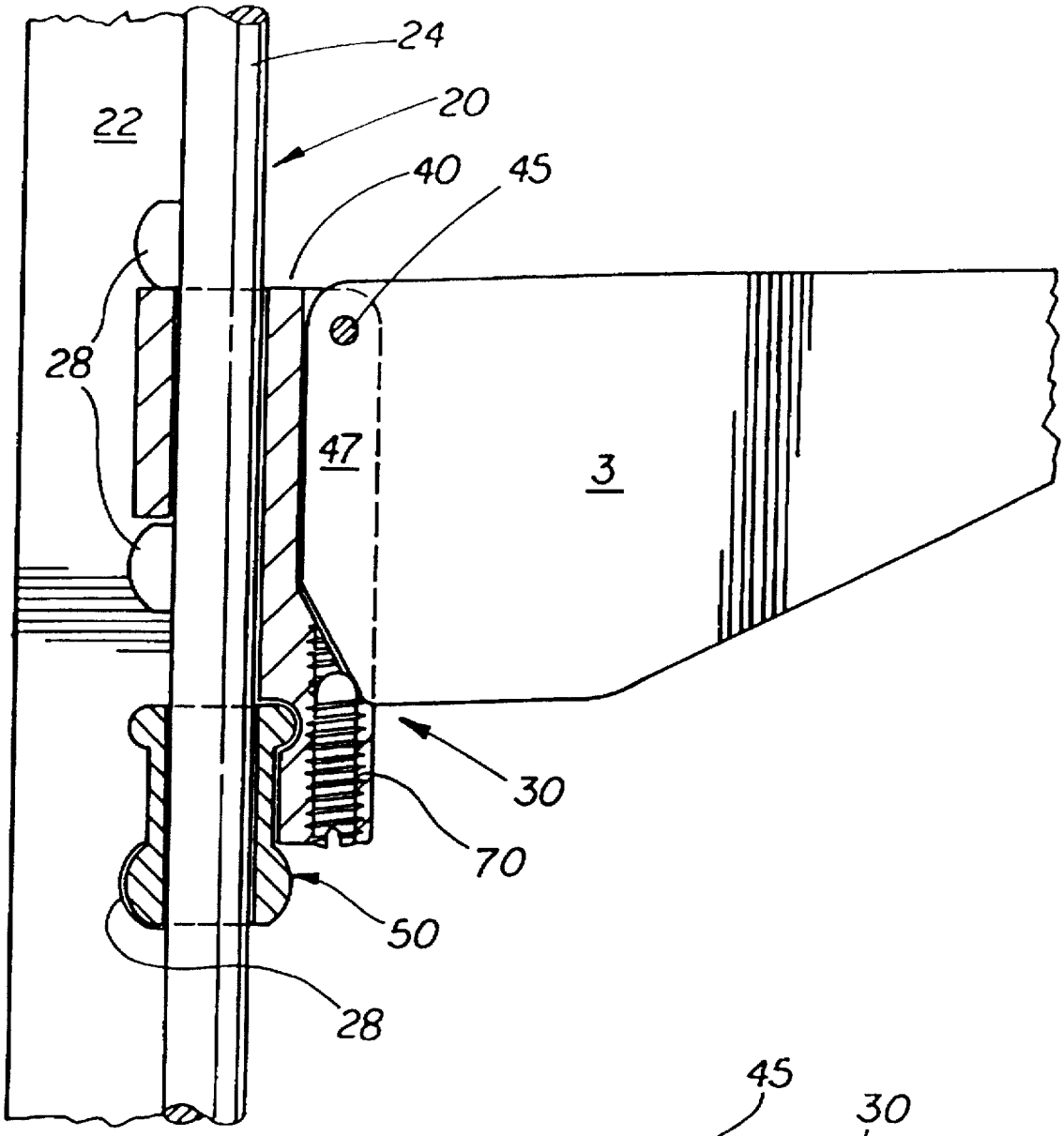
FIG. 12 is a partially sectional side elevation of a further preferred embodiment of the invention having an adjustable shelf bracket.
Figure 16:
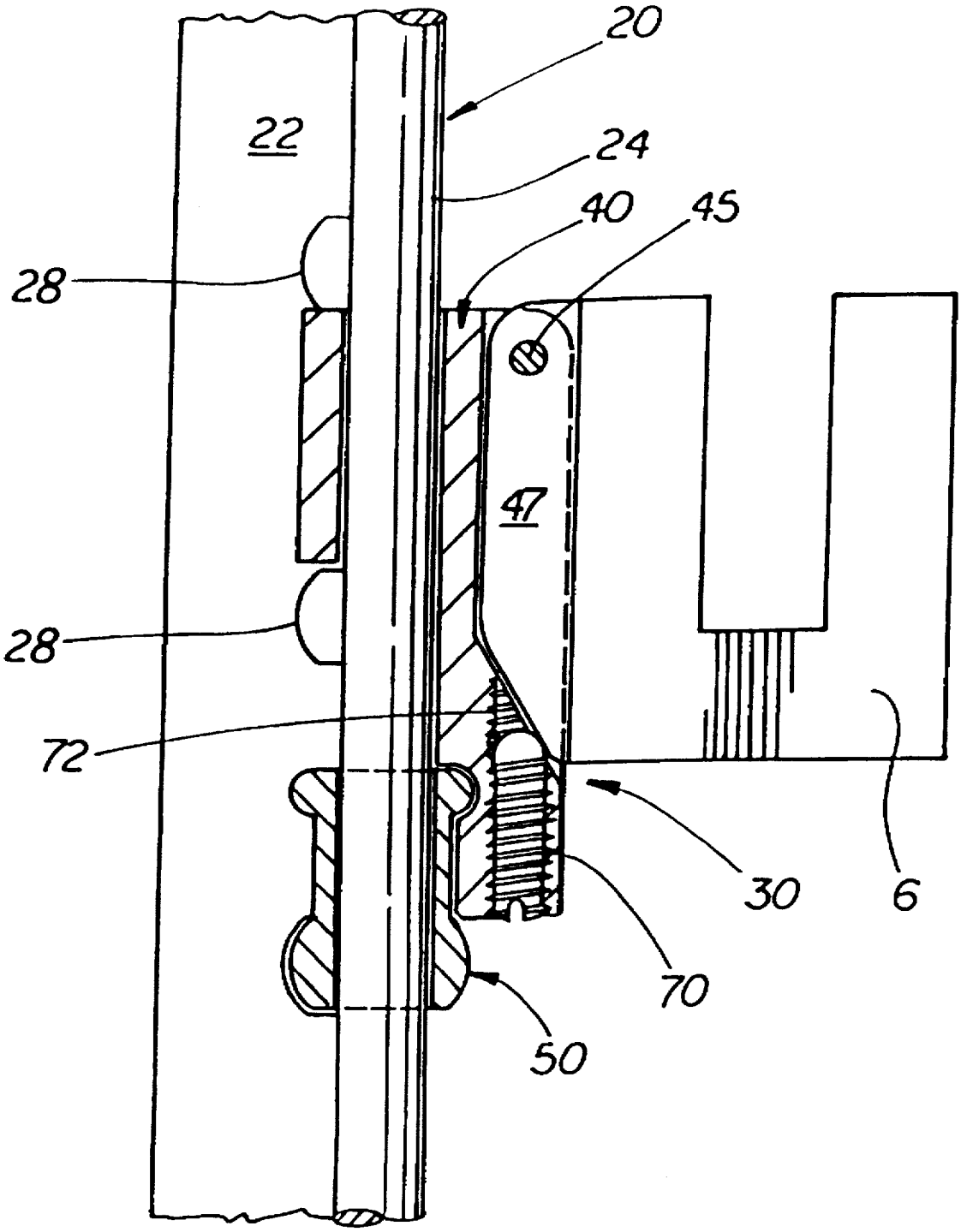
FIG. 16 is a partially sectional side elevation of a the embodiment of FIG. 12 having an adjustable U-hook.

As shown in FIGS. 12 and 16, in which a projecting portion 47 of the hardware is attached within a recess 39 in the sliding body 40, the lower edge of the projecting portion 47 is formed at an oblique angle, and the adjusting screw 70 extends vertically through the bottom of the body 40 to bear against the oblique lower edge. At least a portion of the hole 72 is threaded to engage the screw 70, so that the attitude of the hardware can be adjusted simply by turning the screw 70. As the screw 70 is driven deeper into the body 40, it forces the hardware, for example in the case of FIG. 12 a shelf bracket 3, to tilt upwardly at the front.

In a variation of this adjusting feature the hardware, for example a U-hook 6 in the embodiments illustrated in FIGS. 17 to 19, is provided with a lower extension 37 through which the adjusting screw 70 is threaded horizontally. In this case the adjusting screw 70 bears against the front face of the sliding body 40, setting a lower limit to the pivoting motion of the U-hook 6.

This ability to adjust the attitude or level of the hardware is a particularly valuable feature in the case of a display or shelving unit designed for aesthetic appeal, as it allows for shelves, platforms and supporting hardware to be easily levelled and aligned with one another. Especially in the case of long hardware, such as in the examples shown in FIGS. 14 and 15, the ability to adjust the attitude of the hardware can have a significant effect on the aesthetic appearance of a merchandising or other display unit.

Figure 20:
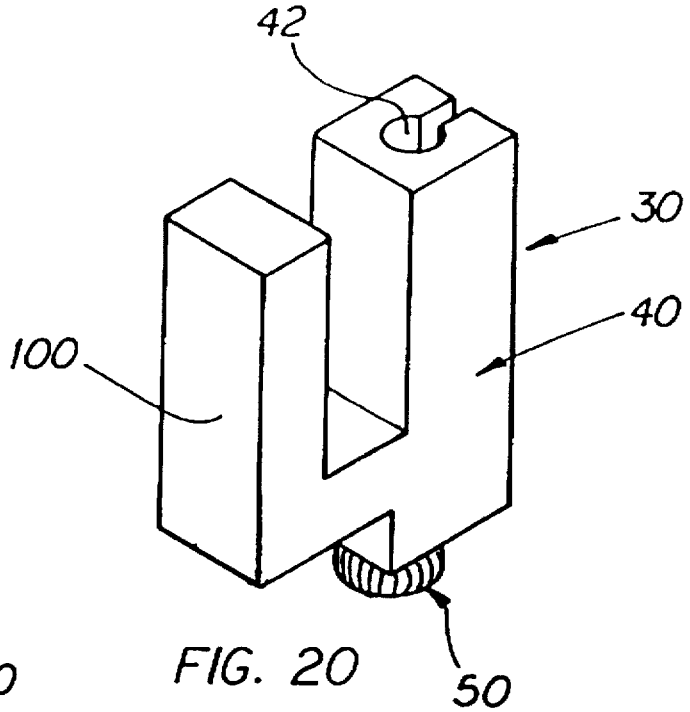
FIG. 20 is a perspective view of a further embodiment of the invention in which the sliding body is formed integrally with a U-hook.
Figure 21:
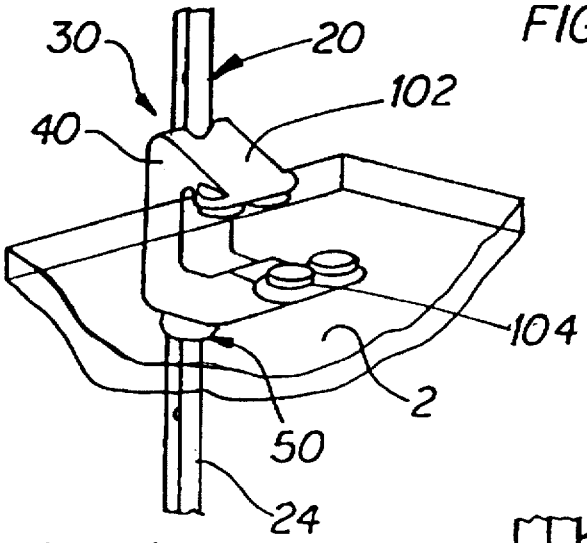
FIG. 21 is a perspective view of a further embodiment of the invention in which the sliding body is formed integrally with a clip for supporting a shelf.
Figure 22:
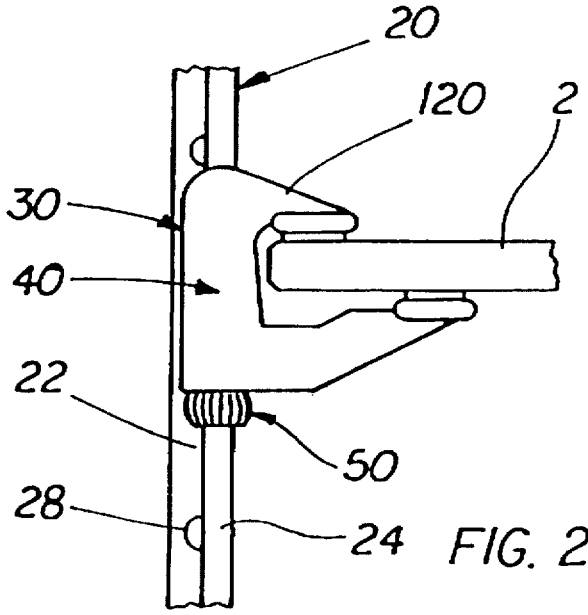
FIG. 22 is a side elevation of the embodiment of FIG. 21.

Although not providing the versatility of the embodiments described above, it is also possible to manufacture support means 30 for the invention wherein the hardware is formed by or integrally with the body. FIG. 20 illustrates a U-hook which is essentially a sliding body 40 formed with an arm 100. Similarly, FIGS. 21 and 22 illustrate a shelf clip for supporting a shelf in cantilevered fashion, in which the sliding body 40 has been formed with upper and lower arms 102, 104. The variations are unlimited, and this embodiment may be appealing in some cases for aesthetic reasons. However, the embodiments in which different configurations of hardware are attached to a single configuration of sliding body 40 may be more economical and require a smaller inventory of hardware.

Preferred embodiments of the invention having been described above by way of example, it will be apparent to those skilled in the art that certain modifications and adaptations may be made without departing from the scope of the invention as set out in the appended claims. All such modifications and adaptations are intended to fall within the invention.

I claim:

1. An adjustable standard system comprising a mounting rail for mounting on a supporting surface, including an enlarged portion forming a substantially continuous bead extending substantially along a front edge of a tongue, the mounting rail comprising a series of openings aligned along the tongue, support means comprising a sliding body slidably disposed on the enlarged portion of the mounting rail, and locking means for engaging the mounting rail and fixing the sliding body at a selected position on the rail.

2. The standard system of claim 1 in which the bead has a circular cross section.

3. The standard system of claim 1 in which the locking means comprises a latch projecting into a slot extending along a locking ring lodged in the sliding body and rotation of the locking ring causes the latch to engage an opening in the mounting rail, the locking ring being restrained against longitudinal movement relative to the sliding body.

4. The standard system of claim 3 in which the locking ring is provided with an annular collar which restrains the locking ring against vertical movement relative to the sliding body.

5. The standard system of claim 4 in which the sliding body is provided with a cavity into which the locking ring is rotatably lodged, and a furrow in which the collar nests.

6. The standard system of claim 4 in which the latch is provided with a detent for engaging an edge of the opening.

7. The standard system of claim 3 in which a locking screw engaged through the sliding body bears against the locking ring to prevent rotation thereof.

8. The standard system of claim 1 in which the mounting rail is provided with hooks for engaging a slotted standard.

9. An adjustable standard system comprising a mounting rail for mounting on a supporting surface, support means comprising a sliding body slidably disposed on the mounting rail, the mounting rail including an enlarged portion for slidably engaging the sliding body, hardware for supporting or suspending an article attached to the sliding body, and locking means for engaging the mounting rail and fixing the sliding body at a selected position on the rail, wherein the hardware is pivotally attached to the sliding body and the sliding body is provided with adjusting means for defining a lower limit to a pivoting motion of the hardware.

10. The standard system of claim 9 in which the adjusting means comprises an adjusting screw engaged through a hole in the sliding body and bearing against the hardware or an adjusting screw engaged through a hole in the hardware and bearing against the sliding body.

* * * * *